US005538092A

United States Patent [19]

Precopia

[11] Patent Number: 5,538,092

[45] Date of Patent: Jul. 23, 1996

[54] FLEXIBLE DRILL PIPE

[75] Inventor: Steven M. Precopia, Garland, Tex.

[73] Assignee: Ingersoll-Rand Company, Woodcliff Lake, N.J.

[21] Appl. No.: 584,577

[22] Filed: Jan. 11, 1996

Related U.S. Application Data

[63] Continuation of Ser. No. 330,157, Oct. 27, 1994, abandoned.

[51] Int. Cl.[6] ..... E21B 7/08

[52] U.S. Cl. ..... 175/74; 175/75; 175/320

[58] Field of Search ..... 175/61, 73, 74, 175/75, 107, 320; 166/384, 385; 285/80, 91, 95, 261, 263; 135/118, 120

[56] References Cited

U.S. PATENT DOCUMENTS

| | | | |
|---|---|---|---|
| 2,680,358 | 6/1954 | Zublin | 285/91 |
| 2,684,581 | 7/1954 | Zublin | 285/261 |
| 2,687,282 | 8/1954 | Sanders . | |
| 3,011,568 | 12/1961 | Grimm | 175/74 |
| 3,446,297 | 5/1969 | Cullen et al. . | |
| 3,958,649 | 5/1976 | Bull et al. | 175/61 |
| 3,995,889 | 12/1976 | Carr et al. | 285/91 |
| 4,143,722 | 3/1979 | Driver . | |
| 4,240,683 | 12/1980 | Crase . | |
| 4,442,908 | 4/1984 | Steenbock . | |
| 4,476,945 | 10/1984 | Hearn . | |
| 4,484,641 | 11/1984 | Dismukes . | |
| 4,640,353 | 2/1987 | Schuh . | |
| 4,693,327 | 9/1987 | Dickinson et al. | 175/73 X |
| 4,848,455 | 7/1989 | Fenyvesi . | |
| 4,880,067 | 11/1989 | Jelsma . | |
| 4,921,057 | 5/1990 | Smet . | |
| 5,007,487 | 4/1991 | Dahle et al. . | |
| 5,040,926 | 8/1991 | Andreasson | 166/385 X |
| 5,085,283 | 2/1992 | Seabourn et al. | 175/61 |
| 5,154,243 | 10/1992 | Dudman | 175/61 X |
| 5,348,096 | 9/1994 | Williams | 166/384 |
| 5,350,018 | 9/1994 | Sorem et al. | 166/384 X |

OTHER PUBLICATIONS

Airflex Brochure, by Eaton.

*Primary Examiner*—Frank Tsay
*Attorney, Agent, or Firm*—John J. Selko

[57] ABSTRACT

A flexible drill pipe includes a plurality of hollow tubular pipe segments, having a longitudinal centerline, the segments being flexibly connected together, each connecting joint a type of joint that permits a limited universal movement between a portion of one pipe segment within in a portion of a second pipe segment, whereby the drill pipe can bend and also can withstand torque loads from rotation during drilling and pullback loads during removal of the drill pipe from a drillhole. An elastomeric seal in each connecting joint provides fluid tight sealing in the joints. A mobile drilling platform includes a powered reel and drill tower for raising and lowering the flexible drill pipe into and out of a drill hole. Pressurized fluid is fed through the drill pipe to drive a down-the-hole drill.

4 Claims, 3 Drawing Sheets

FLEXIBLE DRILL PIPE

This application is a continuation of application Ser. No. 08/330,157, filed Oct. 27, 1994. Which is now abandoned.

BACKGROUND OF THE INVENTION

This invention relates generally to drill pipe and more particularly to flexible drill pipe.

A large majority of down-the-hole rotary drilling machines used in applications such as water well, shallow oil and gas, blast hole, exploration and utility tunnel drilling currently utilize the use of long, straight sections of drilling pipe connected to the drilling device to perform the drilling process. Most drilled holes are deep enough to require the use of several and often many sections of drill pipe which are each inserted and removed from the drill string frequently. The conventional methods of handling these sections of drill pipe are cumbersome, labor intensive and costly.

The foregoing illustrates limitations known to exist in present drill pipe applications. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a flexible drill pipe comprising: a plurality of hollow tubular pipe segments, having a longitudinal centerline, said segments flexibly connected together, each connecting joint being a ball and socket type joint; means for permitting a limited universal movement between a ball member of one pipe segment within in a socket member of a second pipe segment, whereby said drill pipe can bend and also can withstand torque loads from rotation during drilling and pullback loads during removal of said drill pipe from a drillhole; and sealing means in each of said connecting joints for providing fluid tight sealing in said joints.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
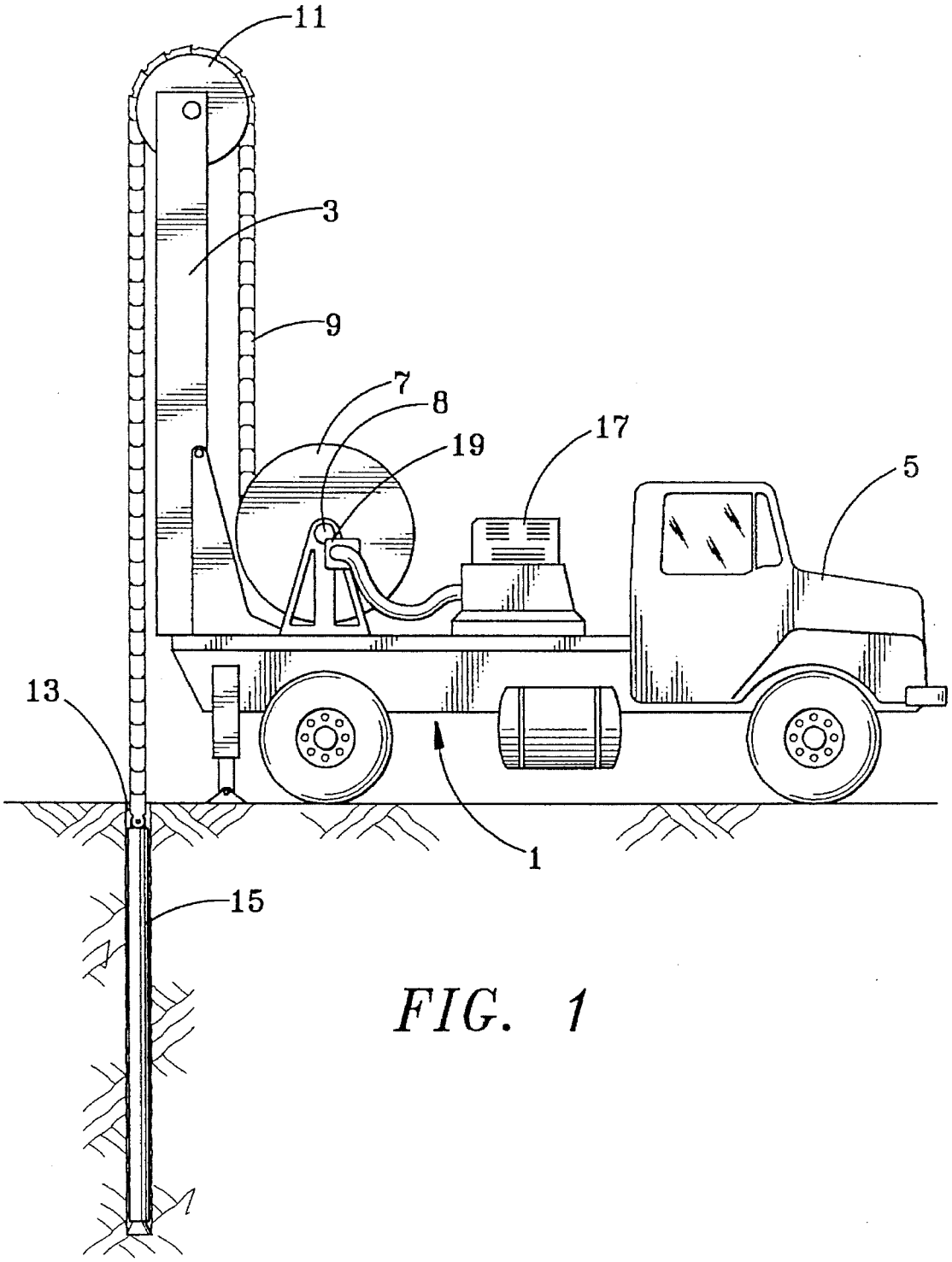
FIG. 1 is schematic plan view of a drilling apparatus of the invention using flexible drill pipe of the invention.
Figure 2:
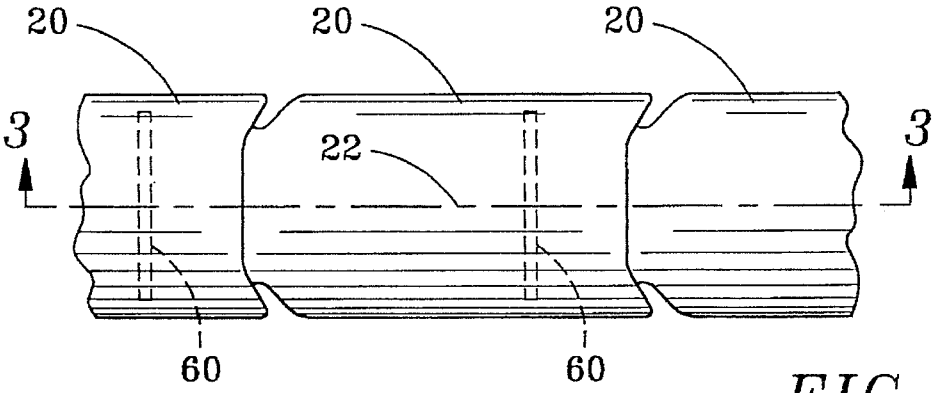
FIG. 2 shows a series of pipe segments flexibly joined together.
Figure 6:
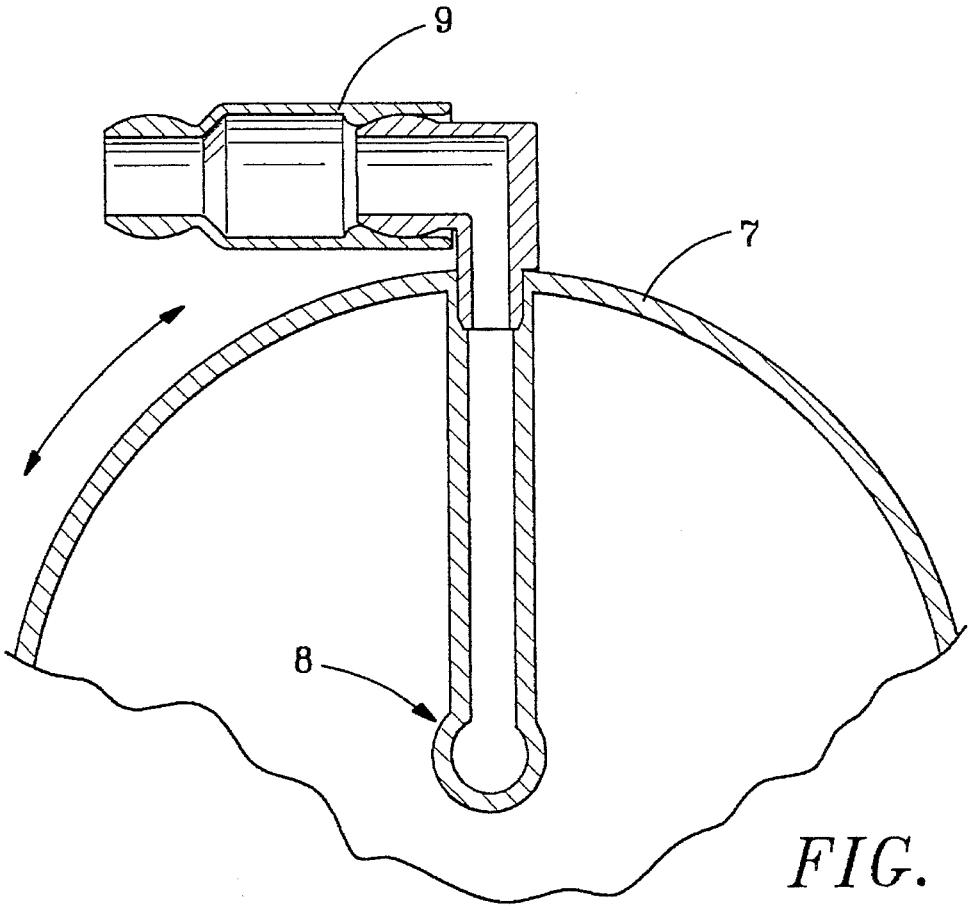
FIG. 6 is a schematic cross-sectional view, with parts removed showing a flexible pipe connected to a supply reel.

Now referring to FIG. 1, there is shown a drilling platform 1 having mounted thereon a drilling tower 3 of conventional design. Tower 3 can be pivoted between a vertical drilling position and a horizontal transport position. Platform 1 may be stationary or mobile. I prefer platform 1 to be mobile by mounting it on a truck 5. Also mounted on platform 1 is a powered rotary supply reel 7 for carrying hollow, flexible drill pipe 9. A crown sheave or powered sprocket 11, configured to accept the flexible drill pipe 9, and raise and lower drill pipe 9 into and out of a drill hole 13. Attached to drill pipe 9 is a conventional down-the-hole rotary drilling device 15 that is powered by pressurized fluid such as air or drilling fluid. Air compressor or drilling fluid pump 17 mounted on platform 1 feeds pressurized fluid into drill pipe 9, via supply reel 7, to power drill 15. As shown in FIG. 6, one end of pipe 9 is fluidly coupled to to powered, rotary reel 7. Transmission of fluid into fluid conducting conduit means 8 on reel 7 is by means of coupling 19 (FIG. 1) suitable for transferring fluid to a rotating assembly. I prefer a conventional rotary fluid coupling commonly available for this type of application. One such coupling that will work is sold under the U.S. registered trademark "AIRFLEX", and supplied by The Eaton Corporation. In the event that a crown sheave 11 is used in the drilling tower 3, the rotary reel 7 will be powered to provide a means to pull on the drill pipe 9, thus generating a pullback force.

Now referring to FIGS. 2–5, the flexible drill pipe 9 of the invention will be described. Drill pipe 9 comprises a plurality of hollow, tubular pipe segments 20 having a longitudinal centerline 22. The segments 20 are flexibly connected together in a joint that provides limited universal movement. By universal movement, I mean movement about three perpendicular axes, i.e the X,Y and Z axis. Preferably, the joint that provides universal movement is a ball and socket type joint.

Each segment 20 is a hollow, elongated tubular member having a sidewall 24 encircling a longitudinal centerline 22. Sidewall 24 terminates in a first end 26 and a second end 28. First end 26 has an external sidewall surface 30 that forms a curved spheroidal male profile shaped end 32 (herein referred to as a "ball"), and second end 28 has an internal sidewall surface 34 that forms a curved spheroidal female profile shaped end 36 (herein referred to as a "socket"). Male profile end 32 fits into female profile end 36 to form a ball and socket joint with an internal passage through which drilling fluid can pass.

End 32 is retained in female end 38 and restrained for only limited universal movement as follows. A pair or apertures 40 are bored through female end 38. Apertures 40 are spaced 180 degrees apart, as measured around the circumference of tubular segment 20. Apertures 40 are bored on a single centerline 42 that is perpendicular to centerline 22. A pair of counter bores 44 are bored into, but not through, external surface 30 of male end 32. Counter bores 44 are spaced 180 degrees apart, as measured around the circumference of tubular segment 20. Counter bores 44 are bored on a single centerline 42 that is perpendicular to centerline 22. A first pivot pin 50 extends through one of said apertures 40 and into one of said counter bores 44. A second pivot pin 52 extends through a second of said apertures 40 and into a second of said counter bores 44. Pivot Pins 50, 52 are retained in the assembly by either sizing the aperture 40 in the female end 36 to provide an interference fit with pins 50, 52 or by sizing counter bores 44 in male end 32 to provide an interference fit with pins 50, 52. Alternatively, pins 50, 52 can be welded to the outside of female end 36

If pivot pins 50, 52 are interference fit into both apertures 40 and counter bores 44, there will not be permitted universal movement of the ball end 32 relative to socket end 36. Only pivoting about pivot pins 50, 52, in a single plane, will be permitted. This type of pipe bending will work, but will require a reel 7 that permits only a single width wrap of flexible pipe 9 wound in multiple layers around the reel 7. I prefer to provide a limited universal movement by sizing either apertures 40 or counter bores 44 larger than pivot pins 50, 52 to provide a loose fit. This permits free rotation about pivot pin centerline 42 and a slight rotation around other axes than centerline 42. The loose fit provides the capability to store the pipe 9 on a spool in a multiple wrap, helically wound, multiple layer fashion.

Figure 3:
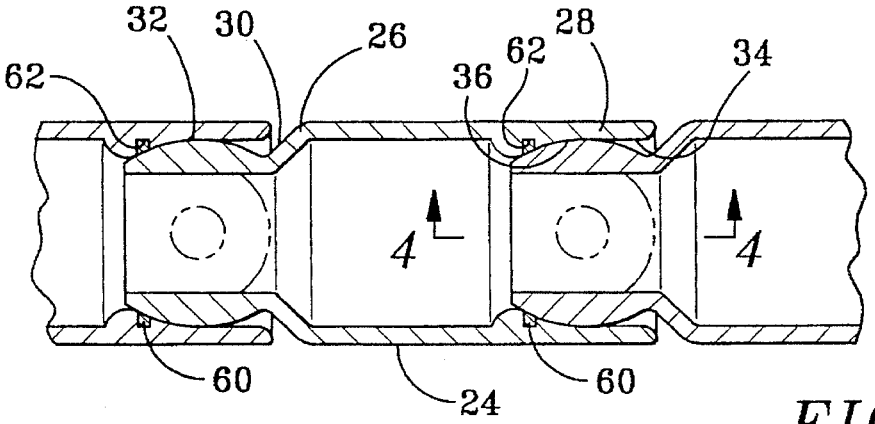
FIG. 3 is a cross-sectional view along A—A of FIG. 2.
Figure 4:
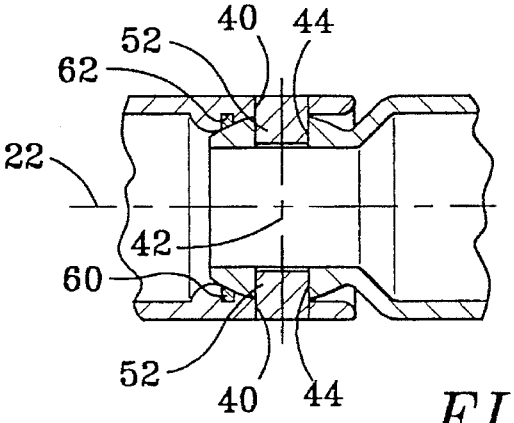
FIG. 4 is a cross-sectional view along B—B of FIG. 3.
Figure 5:
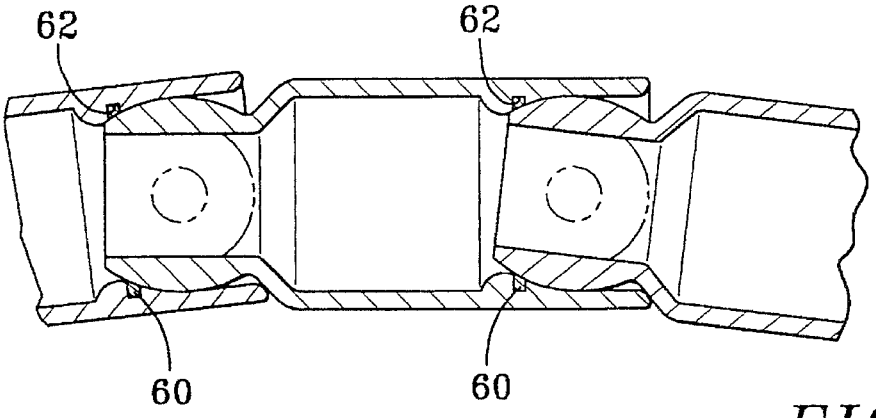
FIG. 5 is a view similar to FIG. 3, but with the drill pipe segments in the flexed condition.

As seen in FIGS. 3–5 seal 60, of conventional elastomeric or rubber composition, is retained in groove 62 machined in female end 36. The function of seal 60 is to contain the pressurized fluid which may be passed through the internal passage of drill pipe 9 and to seal out external contaminants.

Having described the invention, what is claimed is:

1. A flexible drill pipe comprising:

a. a plurality of hollow tubular pipe segments, each segment having a first and second end, each segment having a sidewall encircling a longitudinal centerline, said sidewall forming a spheroidal curved male profile at said first end and a spheroidal curved female profile at said second end, said segments flexibly connected together at a connecting joint at each of said first and second ends, each connecting joint being a ball and socket type joint;

b. means for permitting a limited universal movement between a ball member of one pipe segment within in a socket member of a second pipe segment, whereby said drill pipe can bend and also can withstand torque loads from rotation during drilling and pullback loads during removal of said drill pipe from a drillhole; and c. sealing means in each of said connecting joints for providing fluid tight sealing in said joints.

2. A flexible drill pipe comprising:

a. a plurality of pipe segments, flexibly connected together in a plurality of joints;

b. each pipe segment further comprising:

i. a hollow, elongated tubular member having a sidewall encircling a longitudinal centerline, said sidewall terminating in a first end and a second end;

ii. said first end having an external sidewall surface forming a curved, spheroidal male profile shape;

iii. said second end having an internal sidewall surface forming a curved, spheroidal female profile shape;

b. each joint forming a ball and socket type joint; and c. retaining means for pivotally retaining a male profile first end of a first pipe segment within a female profile second end of an adjacent pipe segment, while permitting a limited universal movement between said first and second ends within said joint; and d. sealing means in each said joint for fluid tight sealing between said first and second ends.

3. The flexible drill pipe of claim 2 wherein said retaining means comprises:

a. a pair of apertures bored through said female second end, spaced 180 degrees apart, along a single centerline perpendicular to said longitudinal centerline;

b. a pair of counter bores, extending into said external surface of said male first end, spaced 180 degrees apart, along a single centerline perpendicular to said longitudinal centerline;

c. a first pivot pin extending through one of said apertures and into one of said counter bores; and d. a second pivot pin extending through a second of said apertures and into a second of said counter bores.

4. The flexible drill pipe of claim 3 wherein said sealing means comprises:

a. an elastomeric seal member between said external sidewall surface of said male profile end and said internal sidewall surface of said female profile end; and b. means for retaining said elastomeric seal member in place.

* * * * *